US009943868B2

(12) United States Patent
Chen

(10) Patent No.: US 9,943,868 B2
(45) Date of Patent: Apr. 17, 2018

(54) HAND PUMP

(71) Applicant: Yi-Wei Chen, Taichung (TW)

(72) Inventor: Yi-Wei Chen, Taichung (TW)

( * ) Notice: Subject to any disclaimer, the term of this patent is extended or adjusted under 35 U.S.C. 154(b) by 0 days.

(21) Appl. No.: 15/397,070

(22) Filed: Jan. 3, 2017

(65) Prior Publication Data

US 2018/0056313 A1 Mar. 1, 2018

(30) Foreign Application Priority Data

Aug. 24, 2016 (TW) ..... 105127154 A

(51) Int. Cl.

| | |
|---|---|
| ***F04B 9/14*** | (2006.01) |
| ***B05B 11/00*** | (2006.01) |
| ***F04B 23/02*** | (2006.01) |
| ***F04B 19/22*** | (2006.01) |

(52) U.S. Cl.

CPC ..... *B05B 11/305* (2013.01); *B05B 11/001* (2013.01); *B05B 11/3011* (2013.01); *B05B 11/3045* (2013.01); *F04B 9/14* (2013.01); *F04B 19/22* (2013.01); *F04B 23/028* (2013.01); *B05B 11/0037* (2013.01)

(58) Field of Classification Search

CPC . B05B 11/001; B05B 11/305; B05B 11/3011; B05B 11/3045; B05B 11/0037; F04B 19/22; F04B 9/14; F04B 23/028; F04B 9/00; F04B 39/121

See application file for complete search history.

(56) References Cited

U.S. PATENT DOCUMENTS

| | | | | |
|---|---|---|---|---|
| 1,744,925 | A * | 1/1930 | Beckwith | F04B 9/14 137/312 |
| 2,642,653 | A * | 6/1953 | Sundholm | B67D 7/60 192/142 R |
| 3,820,800 | A * | 6/1974 | Dorn | F04B 23/028 277/606 |
| 4,946,077 | A * | 8/1990 | Olsen | F16N 3/12 184/105.2 |
| 9,096,995 | B1 * | 8/2015 | Al-Qaneei | E03C 1/0465 |
| 9,745,969 | B2 * | 8/2017 | Viehe | F04B 9/14 |
| 2003/0190240 | A1 * | 10/2003 | Liao | F04B 9/127 417/360 |
| 2009/0008415 | A1 * | 1/2009 | Ohshima | B05B 11/0018 222/383.1 |

* cited by examiner

*Primary Examiner* — Nicholas J Weiss
*Assistant Examiner* — Bob Zadeh
(74) *Attorney, Agent, or Firm* — Muncy, Geissler, Olds & Lowe, P.C.

(57) ABSTRACT

A hand pump for pumping out fluid from a reservoir, comprising a pump body, a faucet, a driving mechanism and a sealing arrangement. The pump body has at a side a connector defining a receptacle radially extending into a cavity of the pump body. The driving mechanism includes an axle inserted in the receptacle of the connector, a sealing sleeve mounted around the axle, a coupling cap axially secured to the sealing sleeve, and a L-shaped handle. The handle having at one end inserted through the coupling cap and the axle, and at the other hand extending outside the coupling cap. Operation of the handle in cyclically up and down motion drives the axle to rotate, which causes a piston in the cavity to move upward and downward so as to suck the fluid into the faucet. The sealing arrangement has at least three O-rings disposed among the parts of the driving mechanism to provide an effective seal between the driving mechanism and the pump body.

9 Claims, 12 Drawing Sheets

HAND PUMP

BACKGROUND OF THE INVENTION

1. Field of the Invention

The present invention relates to a hand pump, and more particularly to a hand pump with a leak-resistant handle arrangement.

2. Description of the Related Art

Attention is initially invited to FIG. 13 which illustrates a conventional oil drum 9 of cylindrical configuration having an upper end wall 90 with a conventional hand operated dispensing pump 91 being mounted in fittings in the upper end wall 90. The lower end of the pump 91 is provided with a coupling member 95. A suction tube 96 is mounted in the lower end of the coupling member 95 and has its lower end positioned adjacent the bottom of the drum 9. Pump 91 is of conventional construction and includes an oscillatable actuator handle 92 which, when oscillated through an angle of approximately 180 degrees, effects the pumping of liquid 93 contained within the drum for discharge through a discharge nozzle 94. However, it should be understood that an oil leaking at the joint between the handle 92 and the pump housing 91 may occur after a long-term use.

SUMMARY OF THE INVENTION

Accordingly, it is an object of the present invention to provide a hand pump to solve the aforementioned problem. Briefly described, the hand pump of this invention includes a pump body, a faucet, a piston assembly, a driving mechanism and a sealing arrangement.

Specifically, the pump body has a first connector at a side, a second connector at an upper end, a third connector at a lower end, and a cavity formed between the upper and lower ends. The first connector has a receptacle radially extending into the cavity. The faucet has an inlet end attached to the second connector of the pump body and an outlet end for discharge of fluid from the cavity. The piston assembly is slidably mounted in the cavity of the pump body and has an one-way valve reciprocally moved so as to suck the fluid into the faucet. The driving mechanism includes an axle, a sealing sleeve, a first coupling cap and an oscillatable actuator handle. The axle is inserted in the receptacle of the first connector of the pump body and positioned in the cavity of the pump body. The sealing sleeve is mounted around the axle and located inside the receptacle. The first coupling cap is secured to an end of the sealing sleeve and axially aligned with the axle. The actuator handle is generally L-shaped and has at one end a rod portion inserted through a central bore of the first coupling cap to a central bore of the axle, and at the other hand a handle portion extending outside the first coupling cap. As such, operation of the handle portion of the actuator handle in cyclically up and down motion drives the axle to rotate, which causes the piston assembly to move upward and downward so as to suck the fluid into the faucet.

Additionally, the sealing arrangement includes at least one first sealing gasket mounted around the axle and radially interposed between the axle and the sealing sleeve, a second sealing gasket mounted around the sealing sleeve and radially interposed between the first connector and the sealing sleeve, and a third sealing gasket axially interposed between the sealing sleeve and the first coupling cap. This sealing arrangement provides an effective seal between the pump body and the driving member. This configuration is beneficial in that if the first sealing gasket is worn out by long use, the third sealing gasket may be pressed further against the peripheral surface of the axle by the coupling cap so as to restore an effective seal.

The foregoing and other objectives, features, and advantages of the invention will be more readily understood upon consideration of the following detailed description of the invention, taken in conjunction with the accompanying drawings.

DETAILED DESCRIPTION OF EMBODIMENTS

Figure 1:
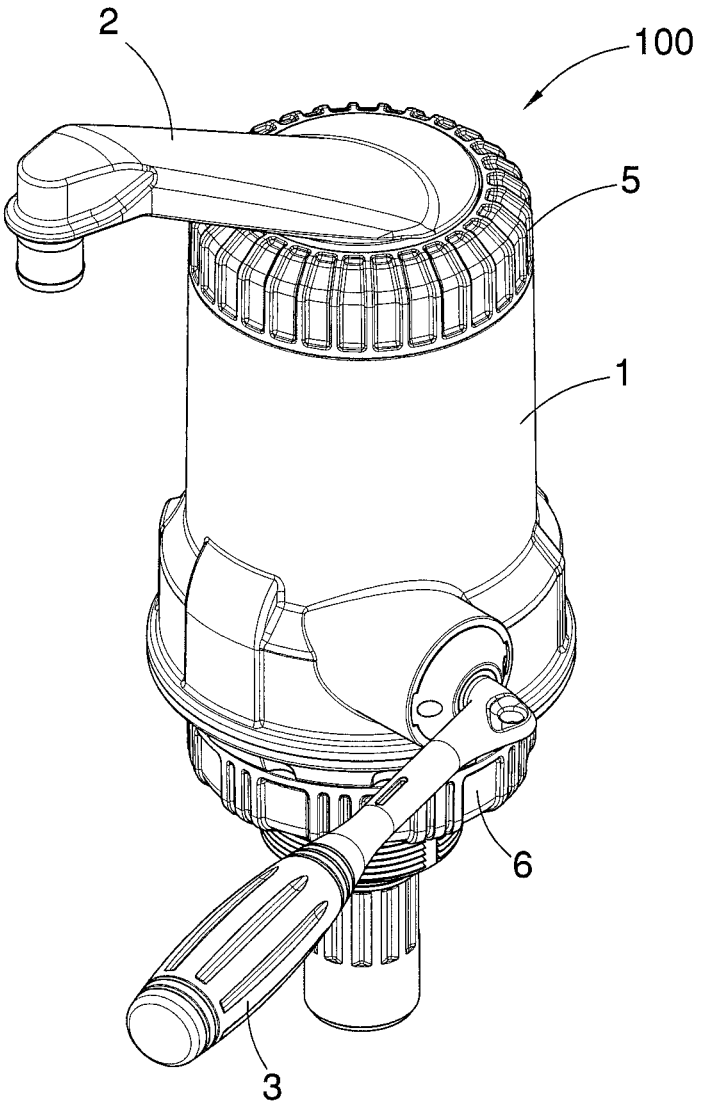
FIG. 1 is a perspective view of a hand pump in accordance with the preferred embodiment of the present invention.
Figure 2:
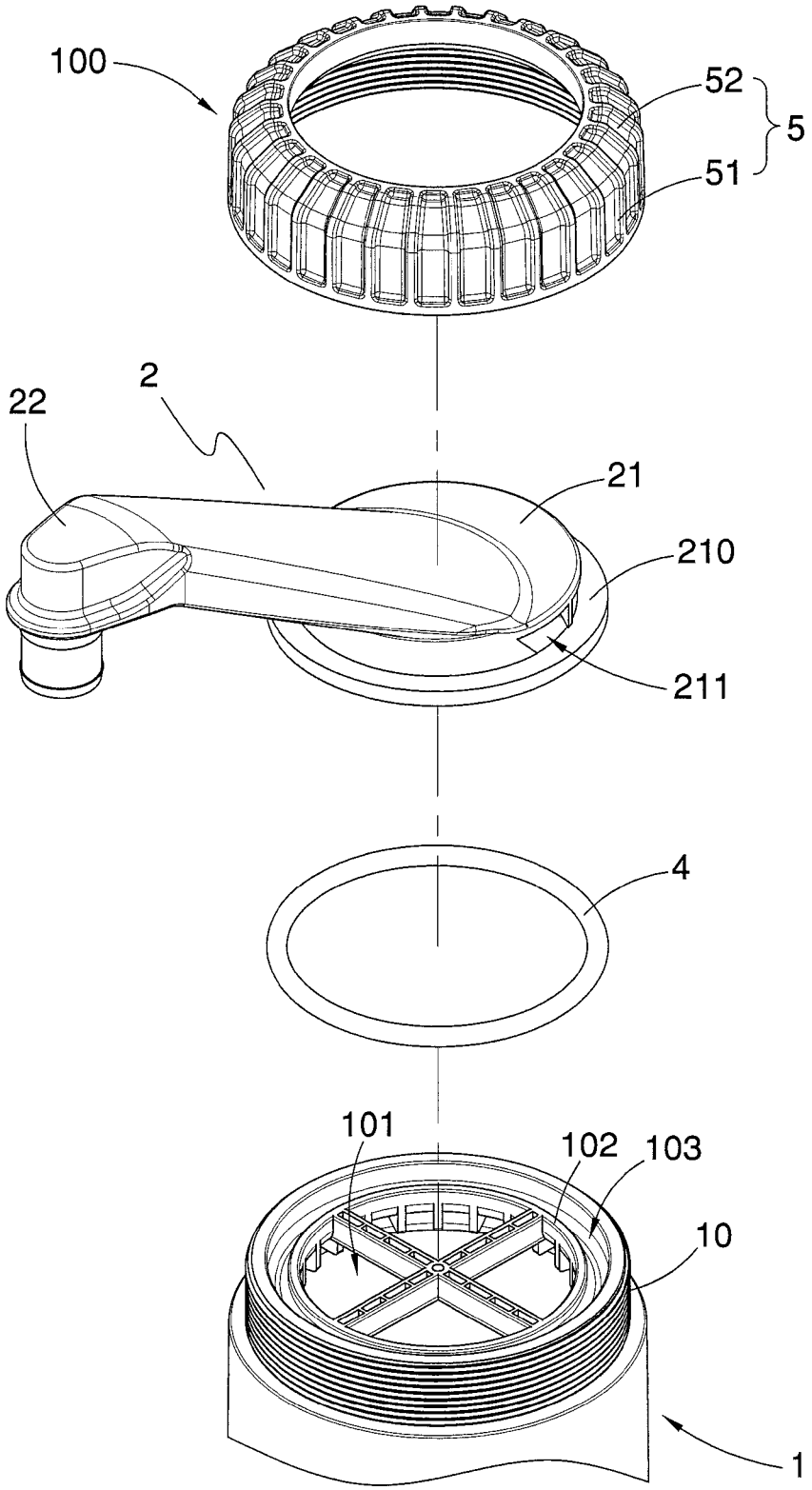
FIG. 2 is a partially exploded perspective view of the hand pump shown in FIG. 1.
Figure 3:
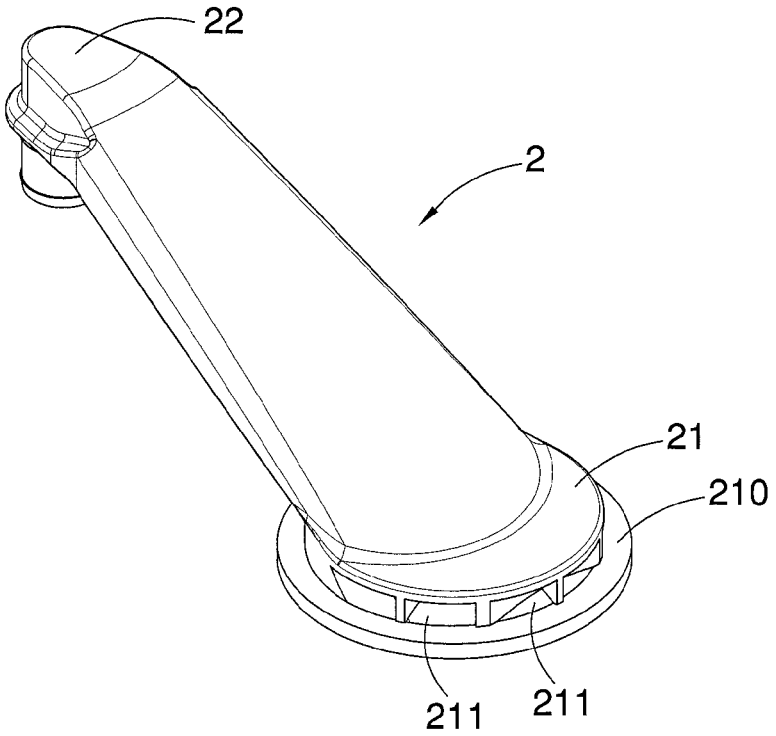
FIG. 3 is a perspective view of a faucet of the hand pump shown in FIG. 2 taken from another angle.

Referring to FIGS. 1-12, there is shown a preferred embodiment of the hand pump 100 for pumping out fluid from a reservoir 8 (FIG. 7) according to the present invention. As shown in FIGS. 1 and 2, the hand pump 100 generally includes a pump body 1, a faucet 2 positioned on top of the pump body 1, a driving mechanism 3 located at a side of the pump body 1, a sealing gasket 4 (see FIG. 9), and a coupling cap 5 holding the faucet 2 onto the pump body 1.

Figure 8:
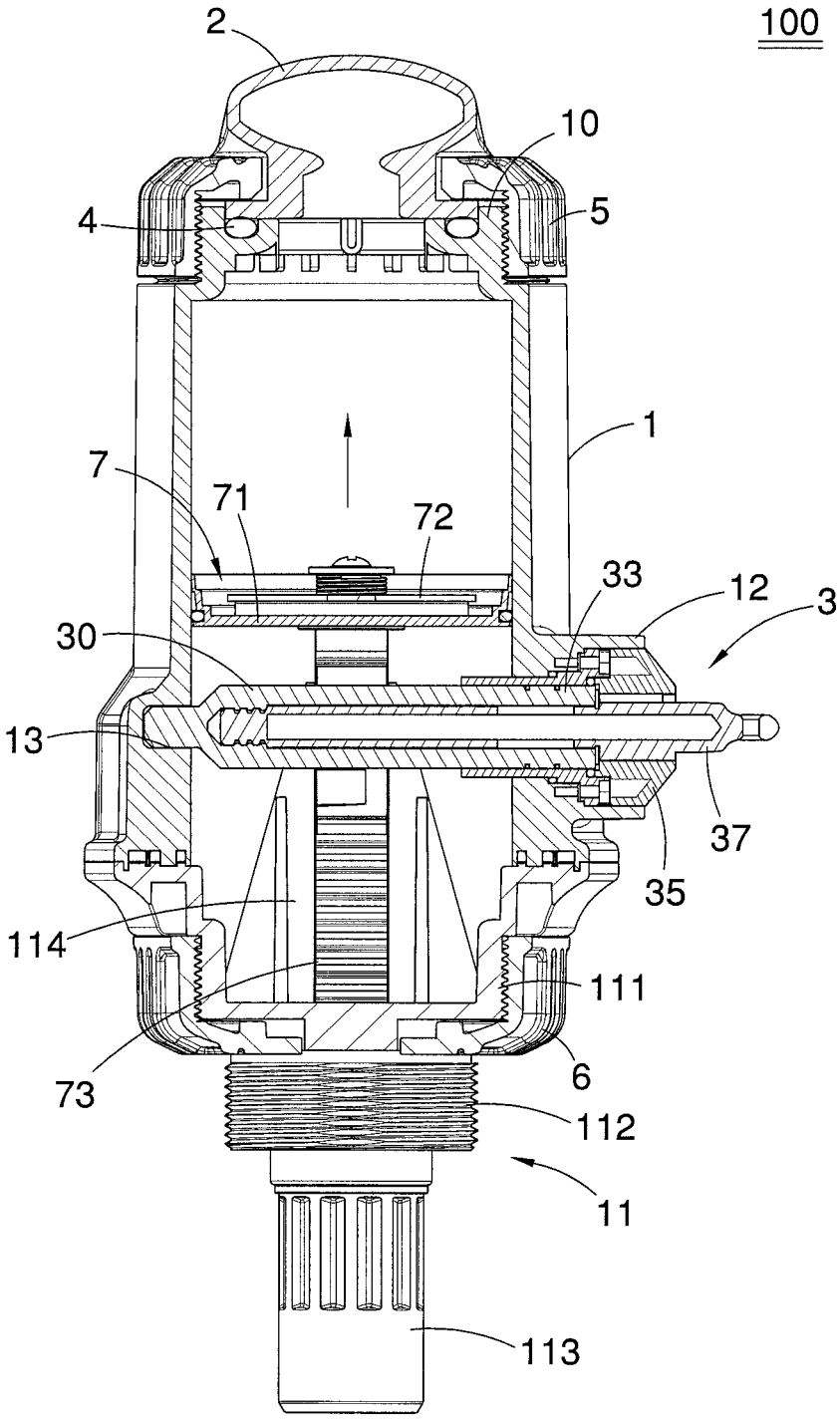
FIG. 8 is a cross-sectional view of the hand pump shown in FIG. 1.

As shown in FIG. 8, the pump body 1 has a first connector 12 at a side, a second connector 10 at an upper end, a third connector 11 at a lower end, and a cavity (not numbered) formed between the upper and lower ends.

Referring back to FIGS. 2 and 4, the faucet 2 has an platelike inlet end 21 joined to the second connector 10 of the pump body 1 and an outlet end 22 for discharge of the fluid. Moreover, the inlet end 21 of the faucet 2 has an upper portion defining a plurality of notches 211 in a periphery thereof and at a lower end a radial outwardly extending flange 210.

Figure 4:
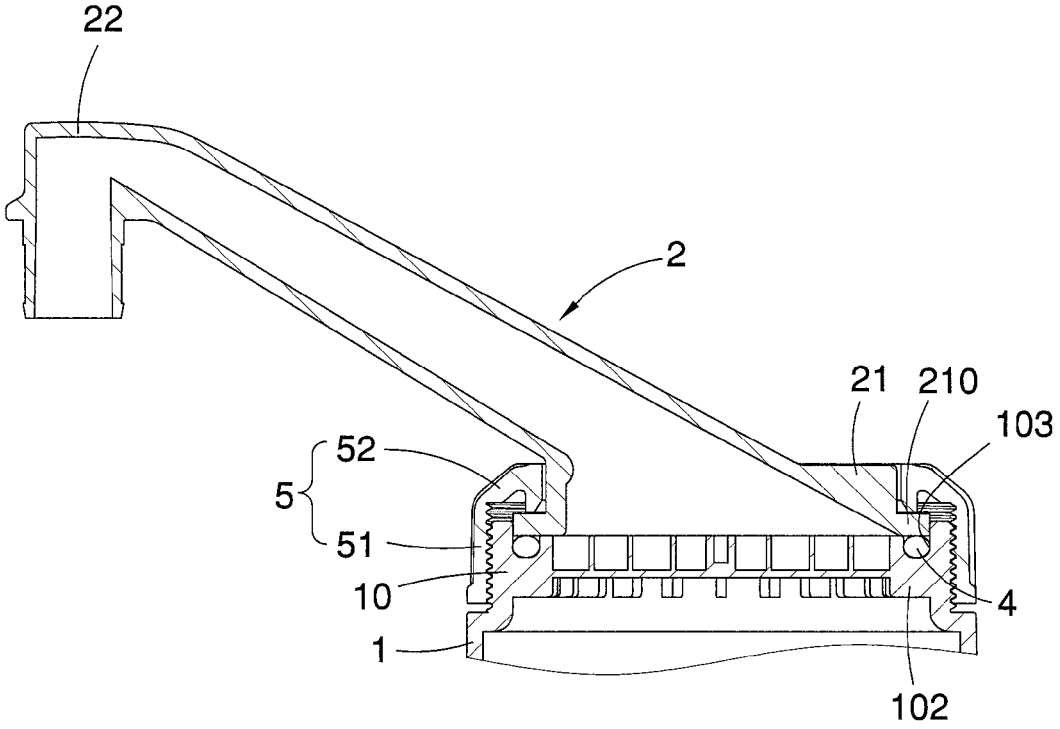
FIG. 4 is a cross-sectional view of the faucet shown in FIG. 3.

As shown in FIG. 2, the second connector 10 of the pump body 1 has an opening 101 extending into the cavity of the pump body 1. The second connector 10 further includes an inner flange 102 radial inwardly extending from an inner wall of the opening 101. The inner flange 102 defines in a top an annular groove 103 in which the sealing gasket 4 is nested, as depicted in FIG. 4.

The coupling cap 5 has an internally threaded cylindrical body 51 and a neck portion 52 inwardly extending from an upper end of the cylindrical body 51. The cylindrical body 51 of the coupling cap 5 is provided to be threadably engaged with the second connector 10 of the pump body 1, as depicted in FIG. 4. On the other hand, the flange 210 of the inlet end 21 of the faucet 2 abuts downward against both of the inner flange 102 of the second connector 10 of the pump body 1 and the sealing gasket 4 received in the annular groove 103 of the inner flange 102. The neck portion 52 of the coupling cap 5 holds the flange 210 of the inlet end 21 of the faucet 2 onto the inner flange 102 of the second connector 10 of the pump body 1. The cooperation between the flange 210 of the inlet end 21 of the faucet 2 and the inner flange 102 of the second connector 10 allows the faucet 2 to rotate with respect to the second connector 10.

Figure 5:
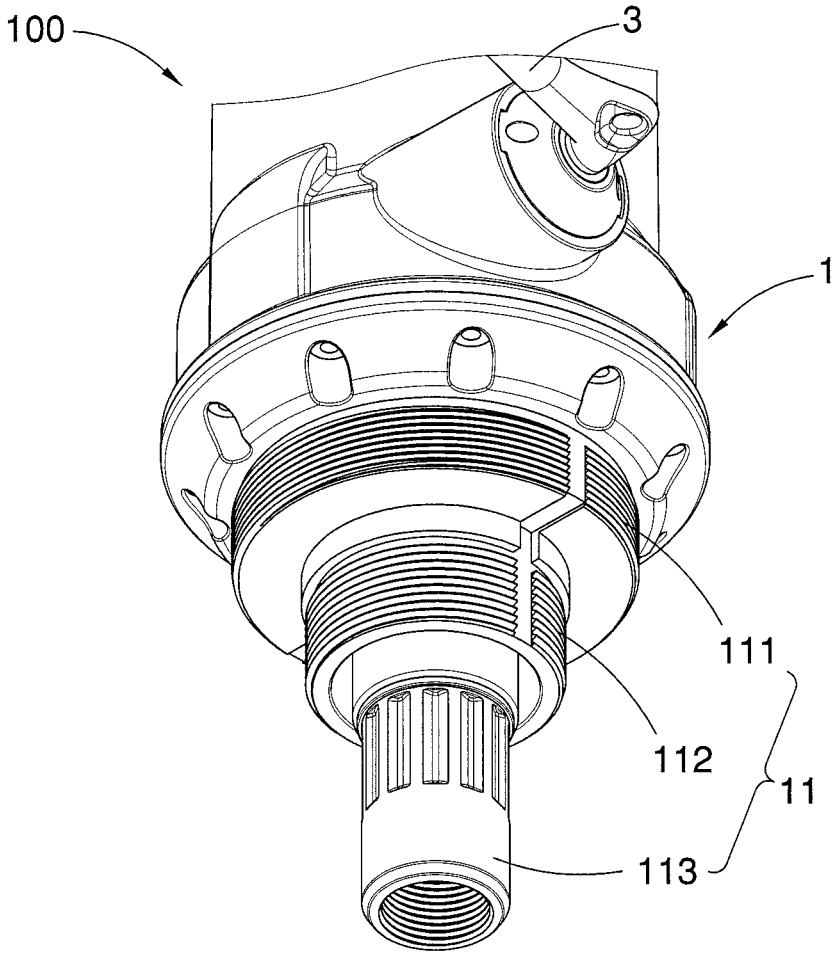
FIG. 5 is a partially exploded perspective view of the hand pump shown in FIG. 1 taken from another angle.
Figure 5:
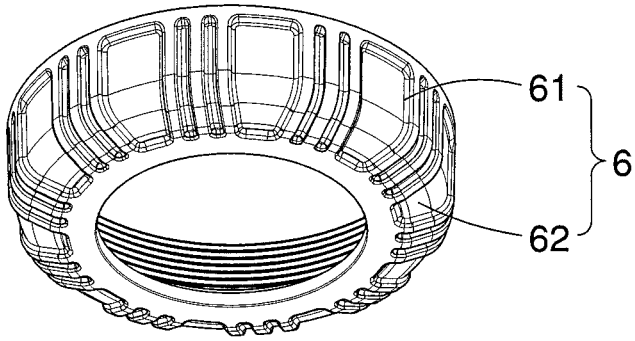

Referring to FIG. 5, the hand pump 100 further includes a lower coupling cap 6 to be attached to the third connector 11 of the pump body 1. Similar to the upper coupling cap 5, the lower coupling cap 6 has an internally threaded cylindrical body 61 and a neck portion 62 inwardly extending from a lower edge of the cylindrical body 61. On the other hand, the third connector 11 of the pump body 1 includes an upper externally threaded section 111 and a lower externally threaded section 112 axially aligned with the upper externally threaded section 111, and a threaded coupling pipe 113 passing through the upper and lower externally threaded sections 111, 112.

Figure 6:
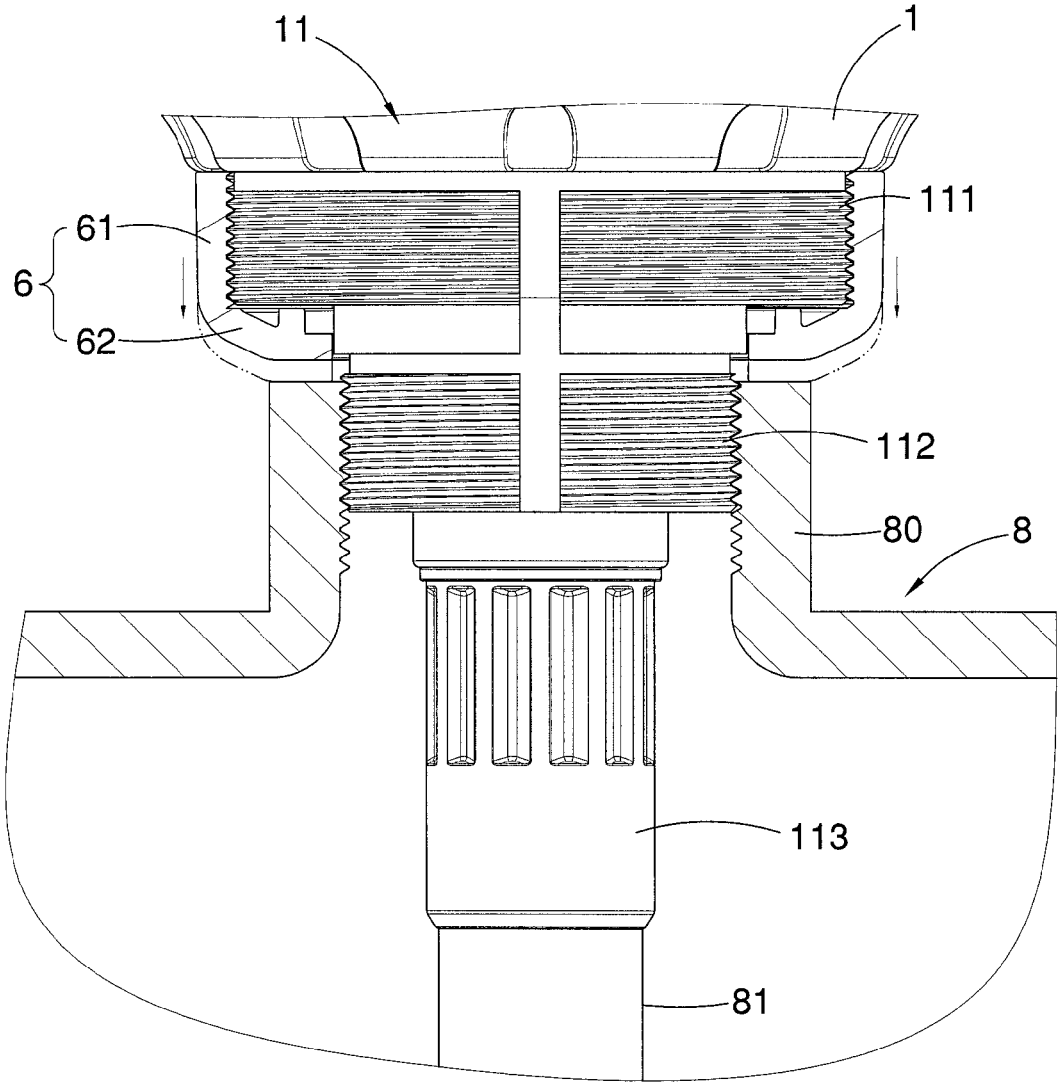
FIG. 6 is a partially cross-sectional view of a reservoir and a lower end of the hand pump shown in FIG. 5.
Figure 7:
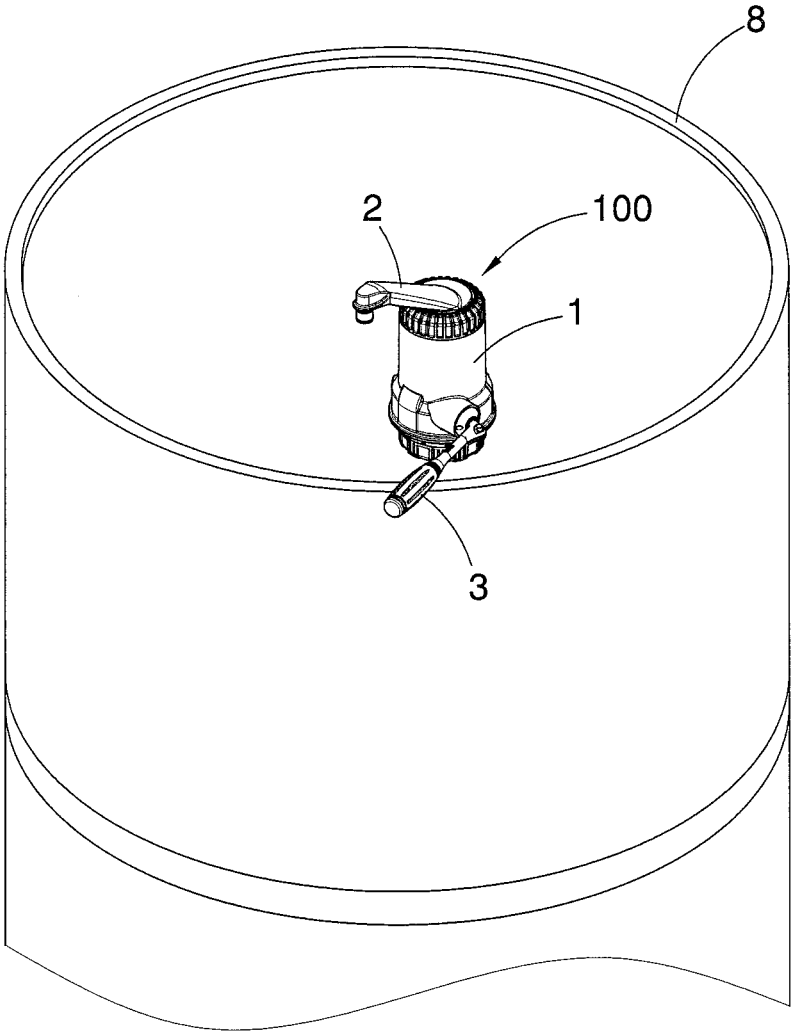
FIG. 7 is a perspective view of the reservoir and the hand pump shown in FIG. 1.

As shown in FIG. 6, the upper externally threaded section 111 of the third connector 11 has a greater diameter than the lower externally threaded section 112 and is provided to be threadably engaged with the cylindrical body 61 of the lower coupling cap 6. The lower externally threaded section 112 of the third connector 11 is configured to be threadably mounted to a threaded fitment 80 of the reservoir 8 while the neck portion 62 of the lower coupling cap 6 abuts against an upper end of the threaded fitment 80 of the reservoir 8, thereby securing the pump body 1 onto the reservoir 8. Besides, the threaded coupling pipe 113 is provided to connect with a suction tube 81 in a known manner.

Figure 9:
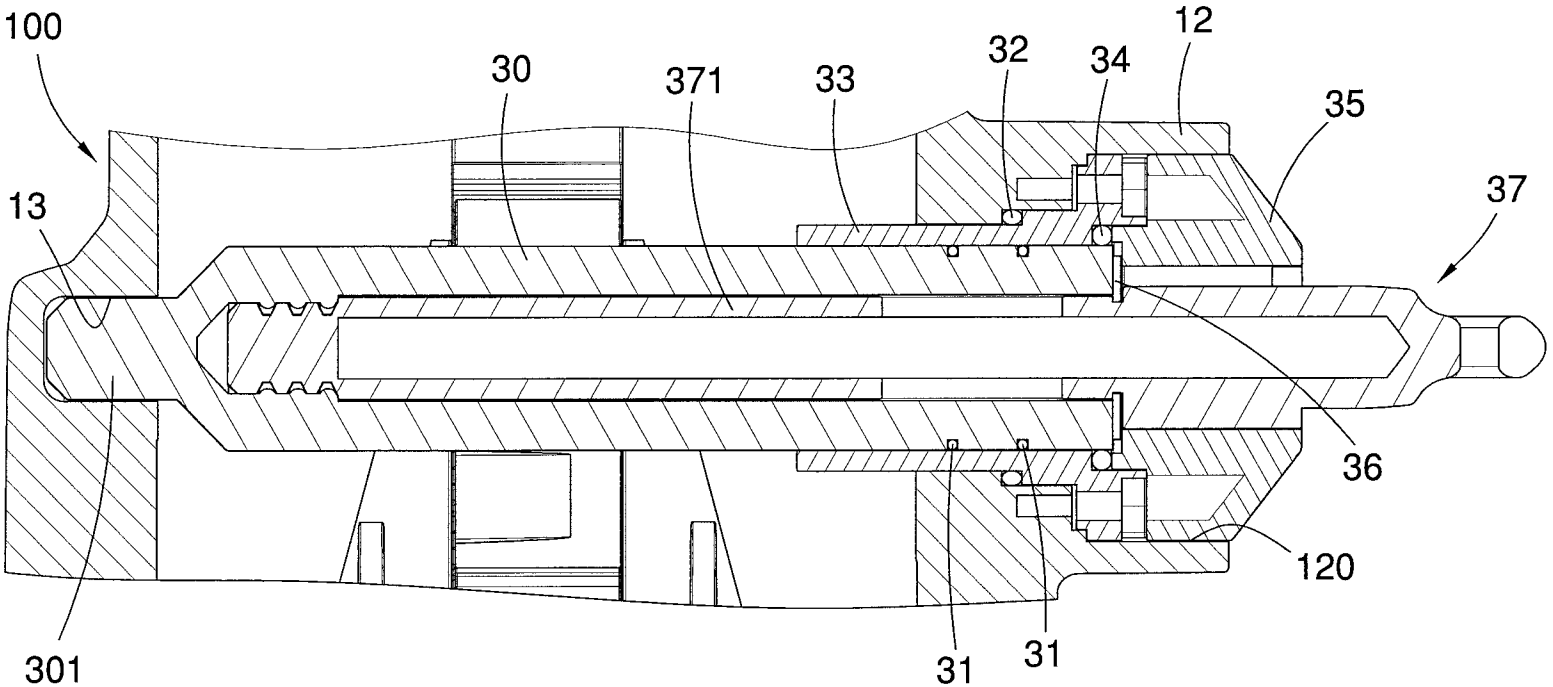
FIG. 9 is a partially enlarged view of FIG. 8.
Figure 10:
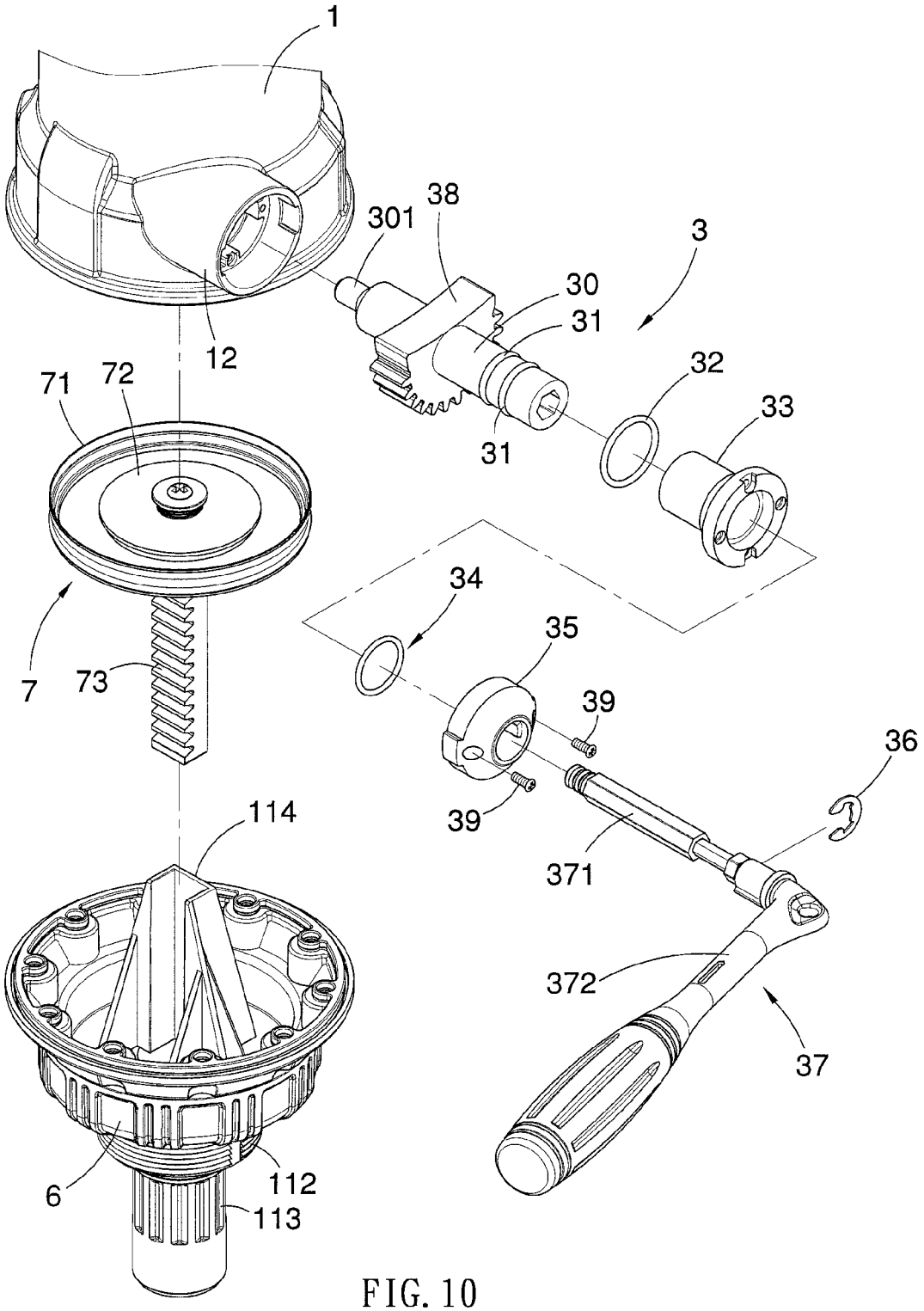
FIG. 10 is a partially exploded perspective view of the hand pump shown in FIG. 1.
Figure 11:
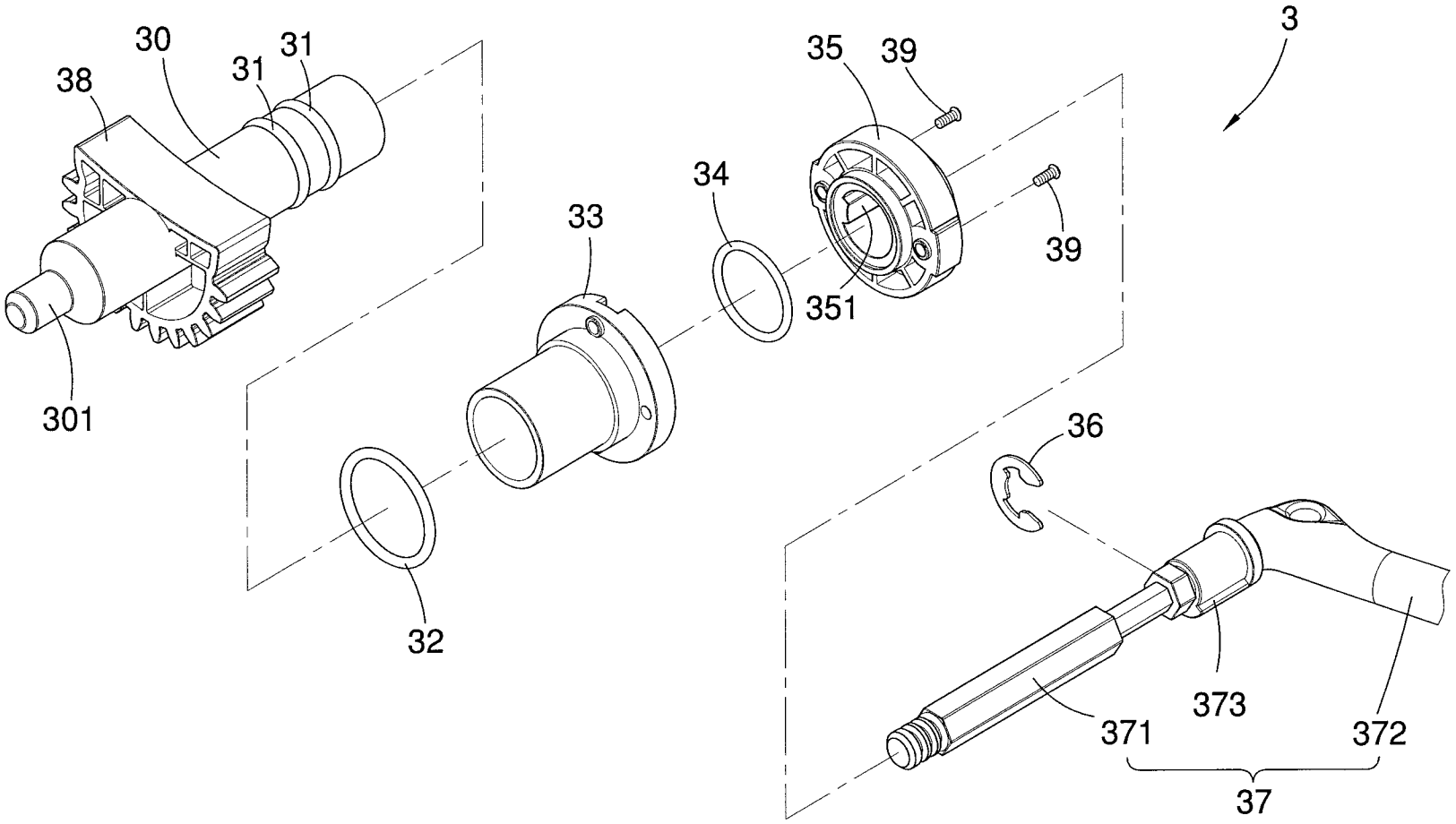
FIG. 11 is another exploded perspective view of a driving mechanism of the hand pump shown in FIG. 10.

Referring to FIG. 8, a piston assembly 7 is slidably mounted in the cavity of the pump body 1. The piston assembly 7 has a piston 71 and an one-way valve 72 reciprocally moved so as to suck the fluid into the faucet 2. As best seen in FIGS. 9-11, the first connector 12 of the pump body 1 has a receptacle 120 radially extending into the cavity, and the driving mechanism 3 includes an axle 30, a sealing sleeve 33, a coupling cap 35, a pair of screws 39, and an oscillatable actuator handle 37. The axle 30 is inserted in the receptacle 120 of the first connector 12 of the pump body 1 and positioned in the cavity of the pump body 1. The sealing sleeve 32 is mounted around the axle 30 and located inside the receptacle 120. The coupling cap 35 is secured to an end of the sealing sleeve 33 by the screws 39 and axially aligned with the axle 30. Additionally, the oscillatable actuator handle 37 is generally L-shaped, and has at one end a rod portion 371 inserted through a central bore of the coupling cap 35 to a central bore of the axle 30, and at the other hand a handle portion 372 extending outside the coupling cap 35. In particular, the rod portion 371 of the actuator handle 37 has a polygonal cross-section, and the central bore of the axle 30 has a polygonal cross-section configured in size and shape to receive the rod portion 371 of the actuator handle 37. The pump body 1 further has a positioning alcove 13 defined in a wall of the cavity to receive a distal end of the axle 30 so that the axle 30 can be firmly held in position. In addition, a metal retainer clip 36 is placed in between the axle 30 and the coupling cap 35 and has its inner edge received in a retainer groove (not numbered) defined in the rod portion 371 to stop the actuator handle 37 from falling off the pump body 12.

Figure 12:
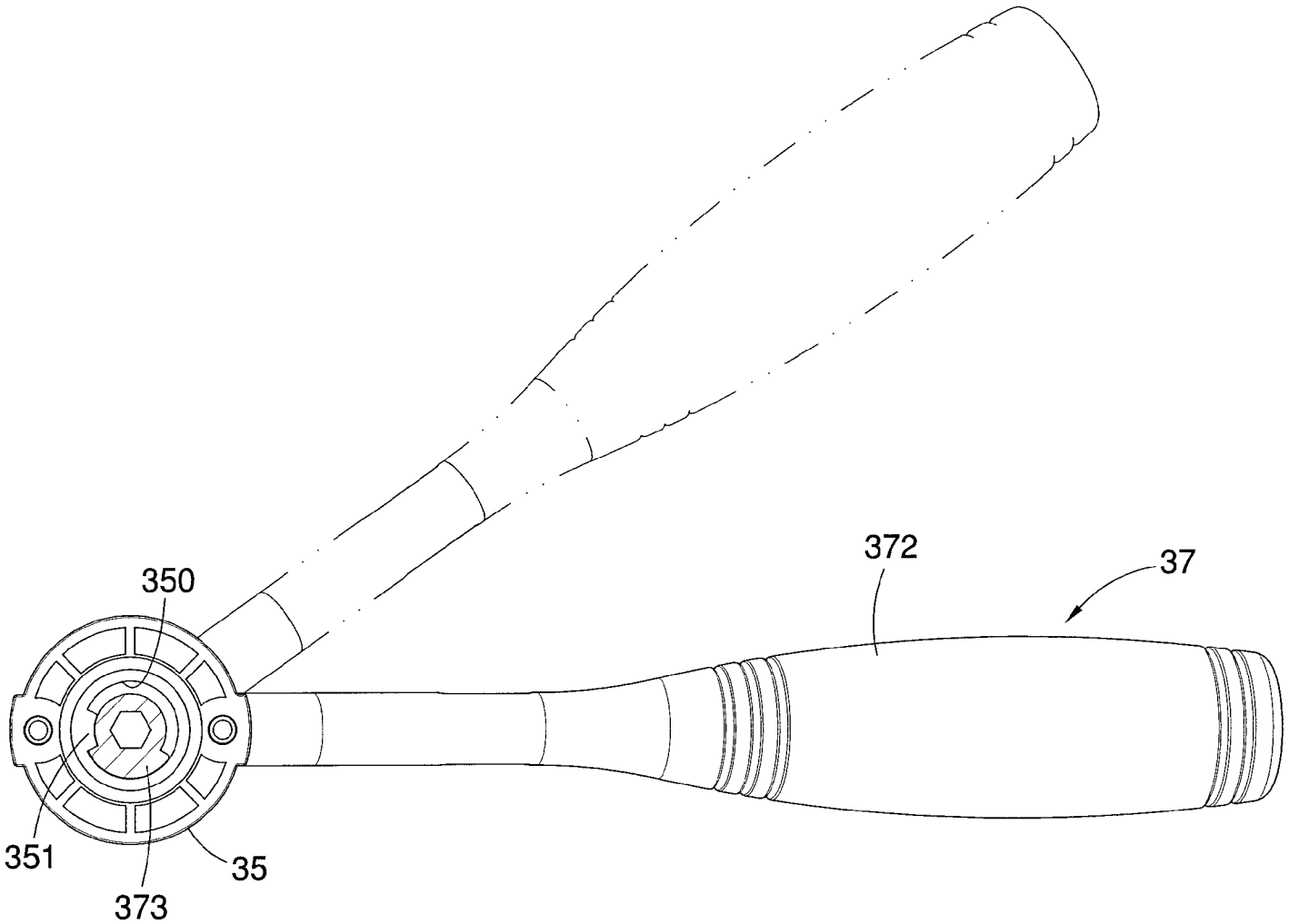
FIG. 12 is a partial enlarged cross-sectional view of the driving mechanism shown in FIG. 11, showing a pivot movement of the handle.
Figure 13:
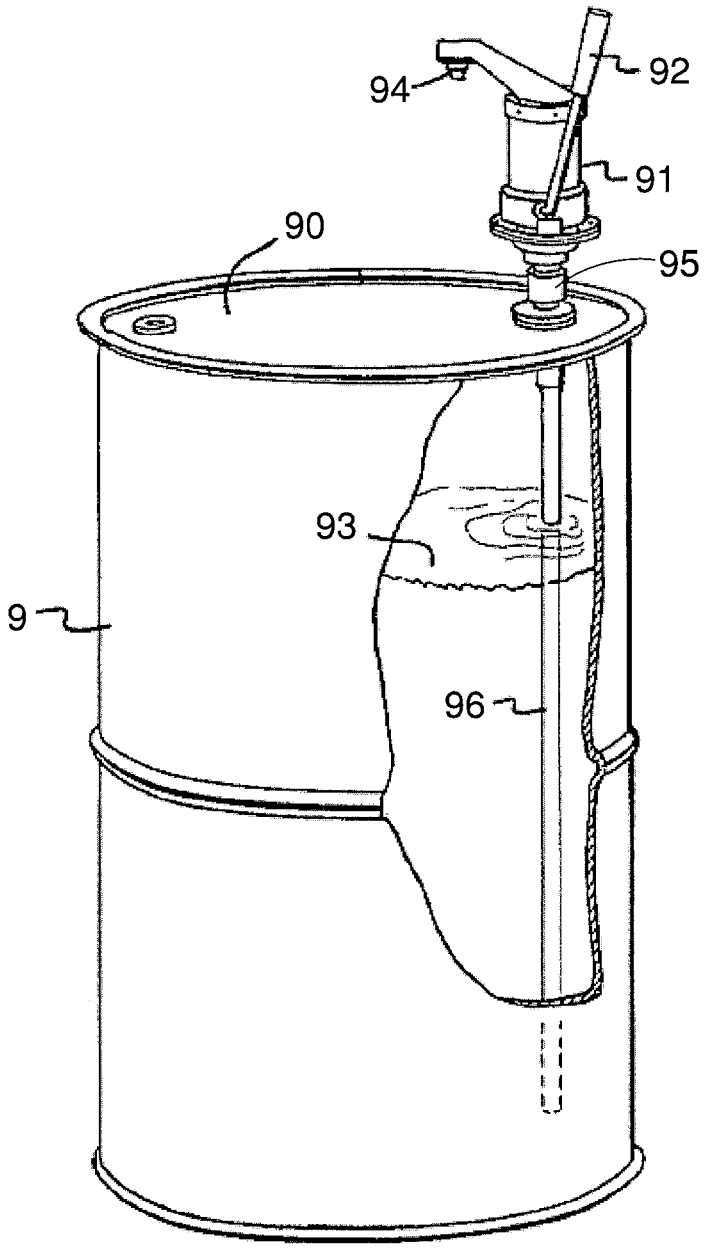
FIG. 13 (Prior Art)
FIG. 13 is a prior art.

As shown in FIG. 11, the actuator handle 37 has a lug 373 radially extending from an end of the rod portion 371 adjacent to the handle portion 372. On the other hand, the coupling cap 35 has a protrusion 351 on a wall of the central bore thereof and corresponding to the lug 373 of the actuator handle 37. In such a manner as depicted in FIG. 12, the protrusion 351 of the coupling cap 35 limits swinging movement of the handle portion 372 of the actuator handle 37 with respect to the pump body 1 by an angle of about 180 degrees.

Furthermore, operation of the handle portion 372 of the actuator handle 37 in cyclically up and down motion drives the axle 30 as well as a pinion 38 integrally forming on the axle 30 to rotate. Since the pinion 38 meshes with a rack 73 formed underneath the piston 72, rotation of the pinion 38 causes the rack 73 as well as the rest portion of the piston assembly 7 to move upward and downward so as to suck the fluid into the faucet 2.

To provide a leak resistant connection between the pump body 1 and the driving mechanism 3, a sealing arrangement may be employed in the hand pump 100 to include two first sealing gasket 31, a second sealing gasket 32 and a third sealing gasket 34. As shown in FIG. 9, the two first sealing gaskets 31 are axially spaced and mounted around the axle 30 and radially interposed between the axle 30 and the sealing sleeve 33. The second sealing gasket 32 is mounted around the sealing sleeve 33 and radially interposed between the first connector 12 and the sealing sleeve 33. The third sealing gasket 34 is axially interposed between the sealing sleeve 33 and the coupling cap 35. This sealing arrangement provides an effective seal between the pump body 1 and the driving member 3 when the parts are in the position illustrated in FIG. 9. This configuration is beneficial in that if the first sealing gaskets 31 are both worn out by long-term use, a user may simply tighten the screws 39 with a screwdriver to have the coupling cap 35 push a bit further against the third sealing gasket 34 so as to restore an effective seal.

It should be evident that this disclosure is by way of example and that various changes may be made by adding, modifying or eliminating details without departing from the fair scope of the teaching contained in this disclosure.

What is claimed is:

1. A hand pump for pumping out fluid from a reservoir, comprising:

a pump body having a first connector at a side, a second connector at an upper end, a third connector at a lower end, and a cavity formed between the upper and lower ends, the first connector having a receptacle radially extending into the cavity;

a faucet having an inlet end attached to the second connector of the pump body and an outlet end for discharge of the fluid;

a piston assembly slidably mounted in the cavity of the pump body and having an one-way valve reciprocally moved so as to suck the fluid into the faucet;

a driving mechanism including an axle inserted in the receptacle of the first connector of the pump body and positioned in the cavity of the pump body, a sealing sleeve mounted around the axle and located inside the receptacle, a first coupling cap secured to an end of the sealing sleeve and axially aligned with the axle, and an oscillatable actuator handle being generally L-shaped, the actuator handle having at one end a rod portion inserted through a central bore of the first coupling cap to a central bore of the axle, and at the other hand a handle portion extending outside the first coupling cap, wherein operation of the handle portion of the actuator handle in cyclically up and down motion drives the axle to rotate, which causes the piston assembly to move upward and downward so as to suck the fluid into the faucet; and a sealing arrangement including at least one first sealing gasket mounted around the axle and radially interposed between the axle and the sealing sleeve, a second sealing gasket mounted around the sealing sleeve and radially interposed between the first connector and the sealing sleeve, and a third sealing gasket axially interposed between the sealing sleeve and the first coupling cap.

2. A hand pump as recited in claim 1, wherein the rod portion of the actuator handle has a polygonal cross-section, and the central bore of the axle has a polygonal cross-section configured in size and shape to receive the rod portion of the actuator handle.

3. A hand pump as recited in claim 2, wherein the pump body further has a positioning alcove defined in a wall of the cavity to receive a distal end of the axle.

4. A hand pump as recited in claim 3, wherein the actuator handle has a lug radially extending from an end of the rod portion adjacent to the handle portion, and the first coupling cap has a protrusion on a wall of the central bore thereof and corresponding to the lug of the actuator handle in a manner to limit swinging movement of the handle portion with respect to the pump body.

5. A hand pump as recited in claim 4, wherein the driving mechanism further includes at least one screw provided to fasten the first coupling cap onto the sealing sleeve.

6. A hand pump as recited in claim 1, further comprising:

a fourth sealing gasket;

a second coupling cap having an internally threaded cylindrical body to be threadably engaged with the second connector of the pump body, and a neck portion inwardly extending from an upper end of the cylindrical body;

the second connector of the pump body having an opening extending into the cavity of the pump body, and an inner flange radial inwardly extending from an inner wall of the opening, the inner flange defining in a top an annular groove in which the fourth sealing gasket is received; and the inlet end of the faucet having a platelike shape and having at a bottom a radial outwardly extending flange abutting downward against both of the inner flange of the second connector of the pump body and the fourth sealing gasket received in the annular groove of the inner flange; and the neck portion of the second coupling cap holding the flange of the inlet end of the faucet onto the inner flange of the second connector of the pump body but permit the faucet to rotate with respect to the second connector.

7. A hand pump as recited in claim 6, wherein the inlet end of the faucet has an upper portion having a plurality of notches radially defined in therein.

8. A hand pump as recited in claim 7, further comprising:

a third coupling cap having an internally threaded cylindrical body and a neck portion inwardly extending from a lower edge of the cylindrical body;

the third connector of the pump body including an upper externally threaded section and a lower externally threaded section axially aligned with the upper externally threaded section, the upper externally threaded section having a greater diameter than the lower externally threaded section and provided to be threadably engaged with the cylindrical body of the third coupling cap, and the lower externally threaded section being configured to be threadably mounted to a threaded fitment of the reservoir while the neck portion of the third coupling cap abuts against the threaded fitment of the reservoir to secure the pump body onto the reservoir.

9. A hand pump as recited in claim 8, wherein the third connector of the pump body further includes a threaded coupling pipe passing through the upper and lower externally threaded sections for connection with a suction tube.

* * * * *